US011118735B2

(12) United States Patent
Schneider

(10) Patent No.: US 11,118,735 B2
(45) **Date of Patent: *Sep. 14, 2021**

(54) MOBILE CO2 FILLING SYSTEM FOR FILLING ONSITE CO2 STORAGE AND DISPENSING SYSTEMS WITH CO2

(71) Applicant: Green CO2 IP, LLC, Fort Collins, CO (US)

(72) Inventor: Daniel Schneider, Worland, WY (US)

(73) Assignee: Green CO2 IP LLC, Fort Collins, CO (US)

( * ) Notice: Subject to any disclaimer, the term of this patent is extended or adjusted under 35 U.S.C. 154(b) by 174 days.

This patent is subject to a terminal disclaimer.

(21) Appl. No.: 16/452,806

(22) Filed: Jun. 26, 2019

(65) Prior Publication Data

US 2019/0360639 A1 Nov. 28, 2019

Related U.S. Application Data

(63) Continuation of application No. 15/300,926, filed as application No. PCT/US2015/023546 on Mar. 31, 2015, now Pat. No. 10,371,318.

(Continued)

(51) Int. Cl.

| | |
|---|---|
| ***F17C 5/02*** | (2006.01) |
| ***F17C 6/00*** | (2006.01) |
| ***F17C 9/00*** | (2006.01) |

(52) U.S. Cl.

CPC ..... *F17C 5/02* (2013.01); *F17C 6/00* (2013.01); *F17C 9/00* (2013.01);

(Continued)

(58) Field of Classification Search

CPC ..... F17C 5/02; F17C 6/00; F17C 9/00; F17C 2203/0639; F17C 2205/0157; F17C 2205/0332

See application file for complete search history.

(56) References Cited

U.S. PATENT DOCUMENTS 1,062,343 A ‡ 5/1913 Mahoney ..... B67D 1/0057 137/17

1,897,167 A ‡ 2/1933 Thomas ..... F17C 7/02 222/62

(Continued)

OTHER PUBLICATIONS

International Search Report and Written Opinion for International (PCT) Patent Application No. PCT/US2015/023546, dated Jul. 9, 2015, 6 pages.‡

(Continued)

*Primary Examiner* — Timothy P. Kelly

(74) *Attorney, Agent, or Firm* — Talus Law Group LLC

(57) ABSTRACT

A mobile CO2 filling system selectively fills onsite CO2 storage and dispensing systems with CO2. The system includes a mobile platform; a tank holding liquid CO2 mounted on the mobile platform; a flexible dispensing hose couple to the tank and configured to be selectively coupled to the filling inlet of an onsite CO2 storage and dispensing system; a pump selectively coupled to the tank; and a controller for controlling the filling of an onsite CO2 storage and dispensing systems with CO2 from the tank, wherein the controller is selectively designated by the user to operate in at least one pump assisted filling state and at least one gravity feed filling state.

18 Claims, 6 Drawing Sheets

Related U.S. Application Data

(60) Provisional application No. 61/973,213, filed on Mar. 31, 2014.

(52) U.S. Cl.
CPC ..... *F17C 2203/0639* (2013.01); *F17C 2205/0157* (2013.01); *F17C 2205/0332* (2013.01); *F17C 2205/0338* (2013.01); *F17C 2221/013* (2013.01); *F17C 2223/0153* (2013.01); *F17C 2223/033* (2013.01); *F17C 2223/046* (2013.01); *F17C 2225/0153* (2013.01); *F17C 2225/035* (2013.01); *F17C 2227/0121* (2013.01); *F17C 2227/0135* (2013.01); *F17C 2265/06* (2013.01); *F17C 2270/0171* (2013.01)

(56) References Cited

U.S. PATENT DOCUMENTS 4,683,921 A ‡ 8/1987 Neeser ..... B67D 1/07 141/1
4,936,343 A ‡ 6/1990 Pruitt ..... F17C 7/04 137/57
5,088,436 A * 2/1992 Stritmatter ..... F17C 5/02 137/263
5,113,905 A ‡ 5/1992 Pruitt ..... F17C 7/04 137/53
5,954,101 A ‡ 9/1999 Drube ..... F16K 31/30 141/18
5,975,162 A ‡ 11/1999 Link, Jr. ..... F17C 13/002 141/192
6,601,618 B2 ‡ 8/2003 Tsukano ..... B67C 3/10 141/29
6,955,198 B2 ‡ 10/2005 Wodjenski ..... F17C 7/00 141/10
7,258,127 B1 ‡ 8/2007 Schneider ..... F17C 13/04 137/10
7,591,290 B2 ‡ 9/2009 Bourgeois ..... F17C 5/007 141/231
7,766,309 B1 ‡ 8/2010 Smythe ..... F16K 11/044 261/62
8,757,437 B2 ‡ 6/2014 Schneider ..... B67D 1/04 222/12
8,844,555 B2 ‡ 9/2014 Schneider ..... B67D 1/0057 137/10

OTHER PUBLICATIONS

International Preliminary Report on Patentability for International (PCT) Patent Application No. PCT/US2015/023546, dated Oct. 13, 2016, 6 pages.‡

* cited by examiner
‡ imported from a related application

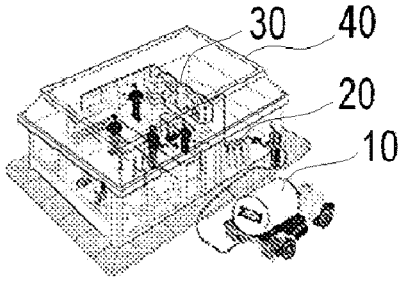
FIG. 1
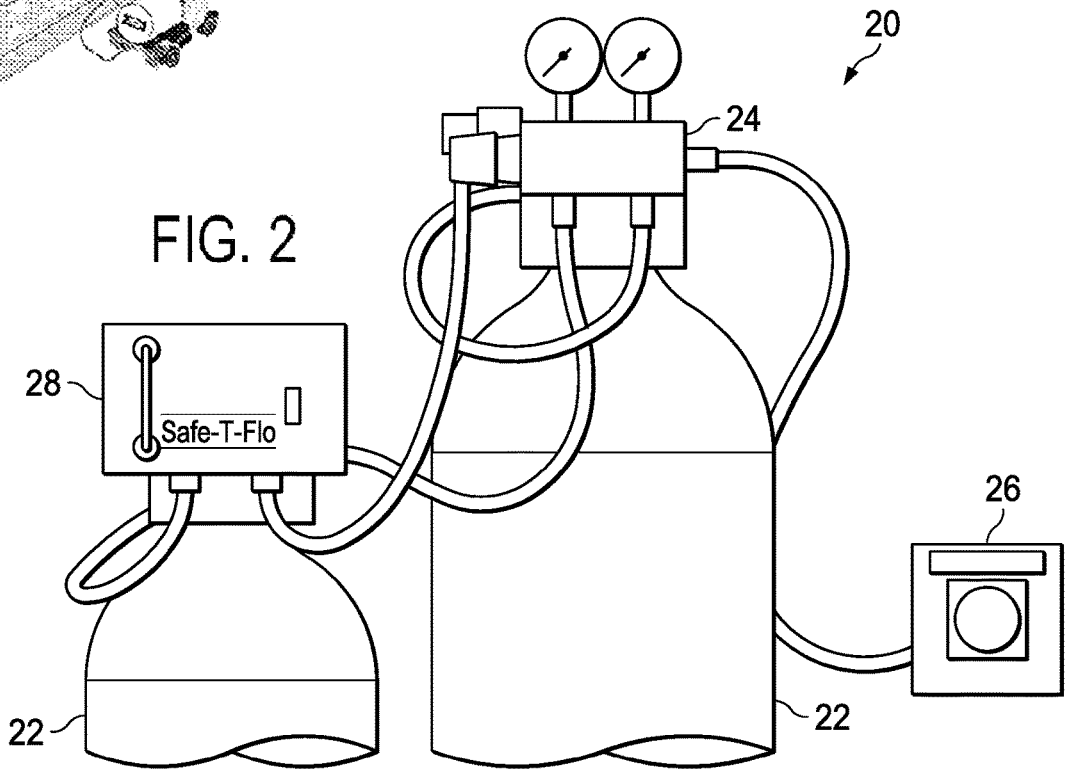
FIG. 2
FIG. 3
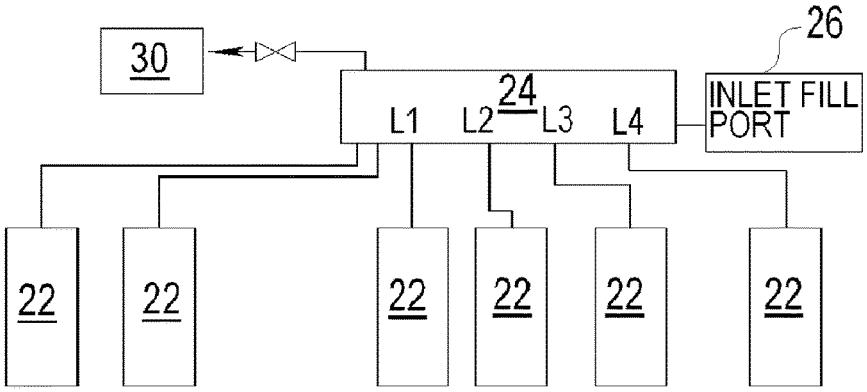

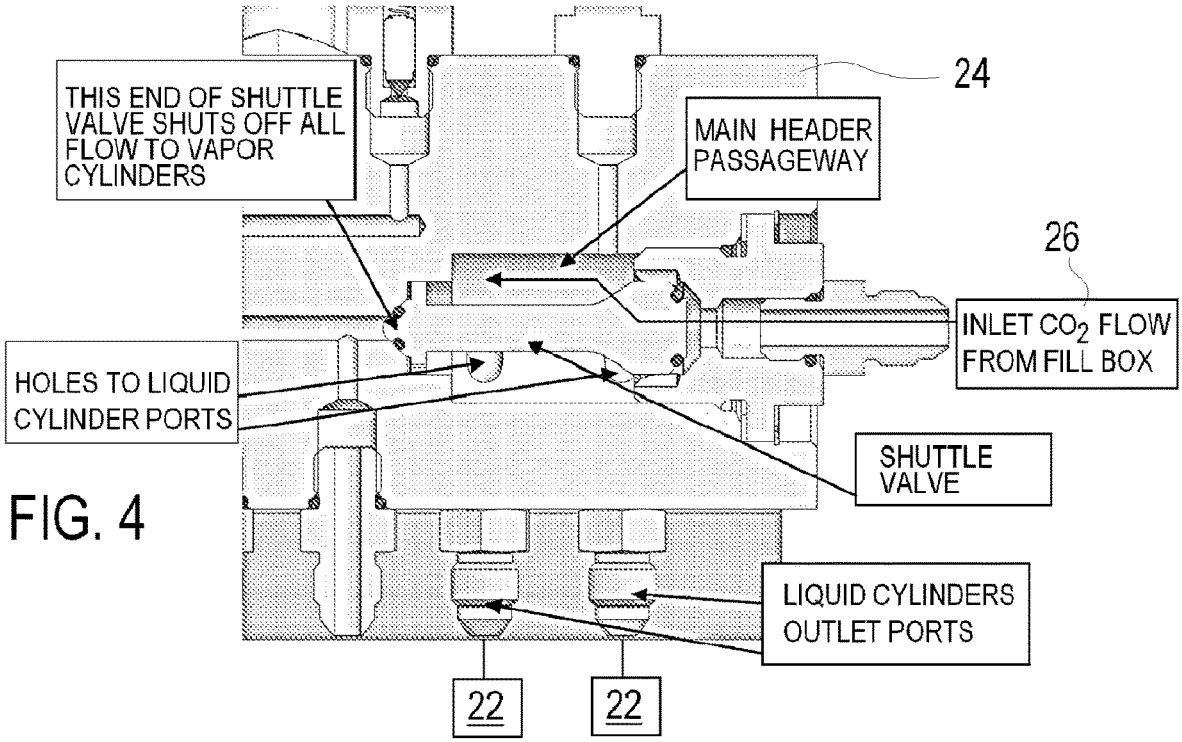
FIG. 4
FIG. 7
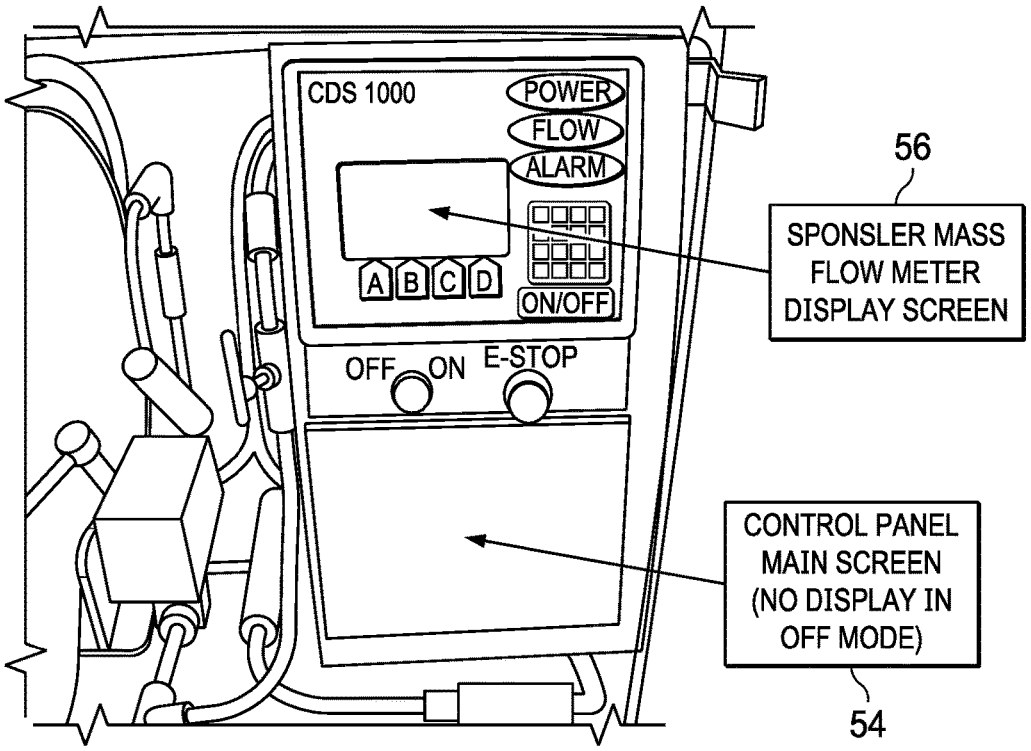

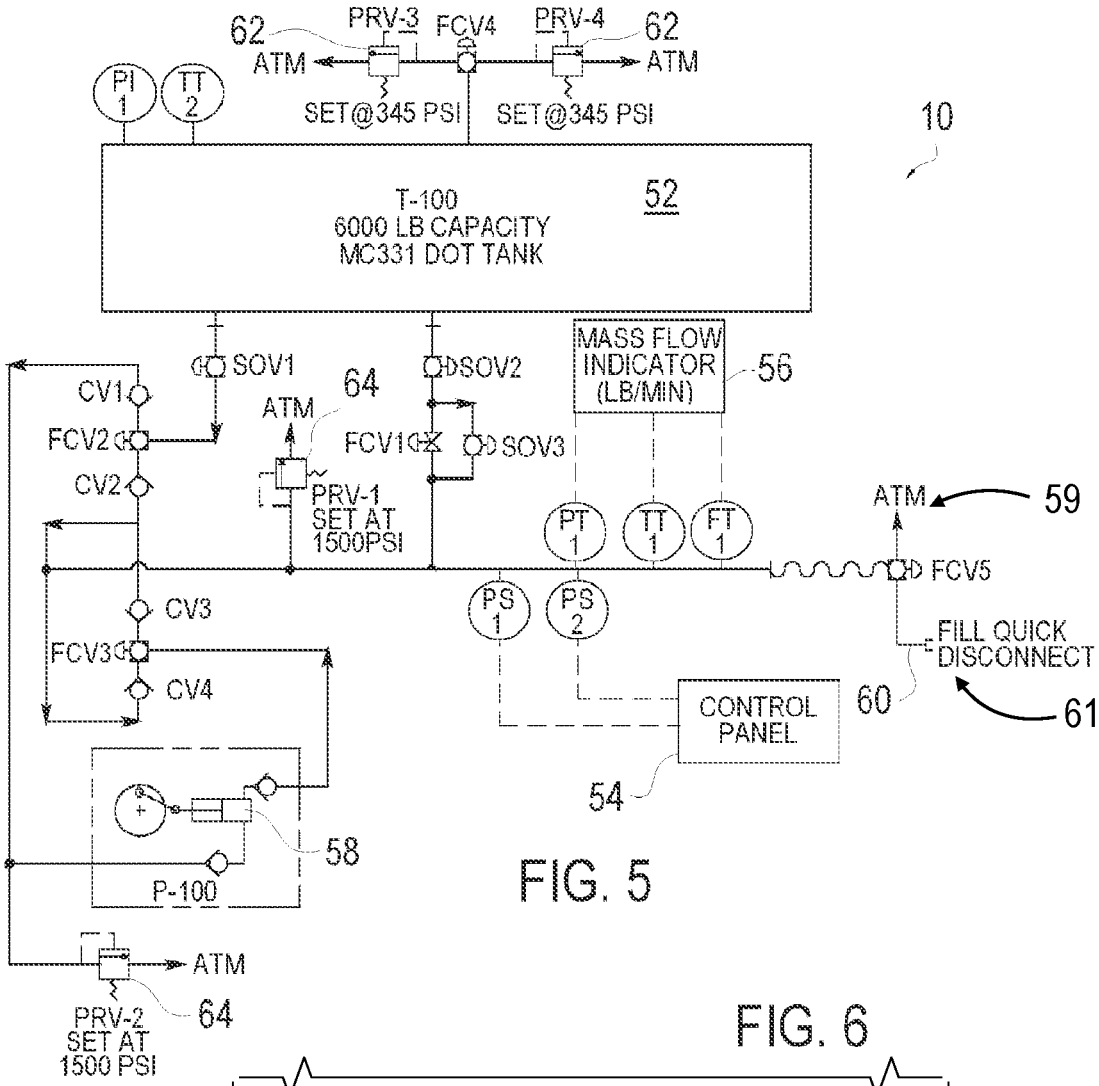
FIG. 5
FIG. 6
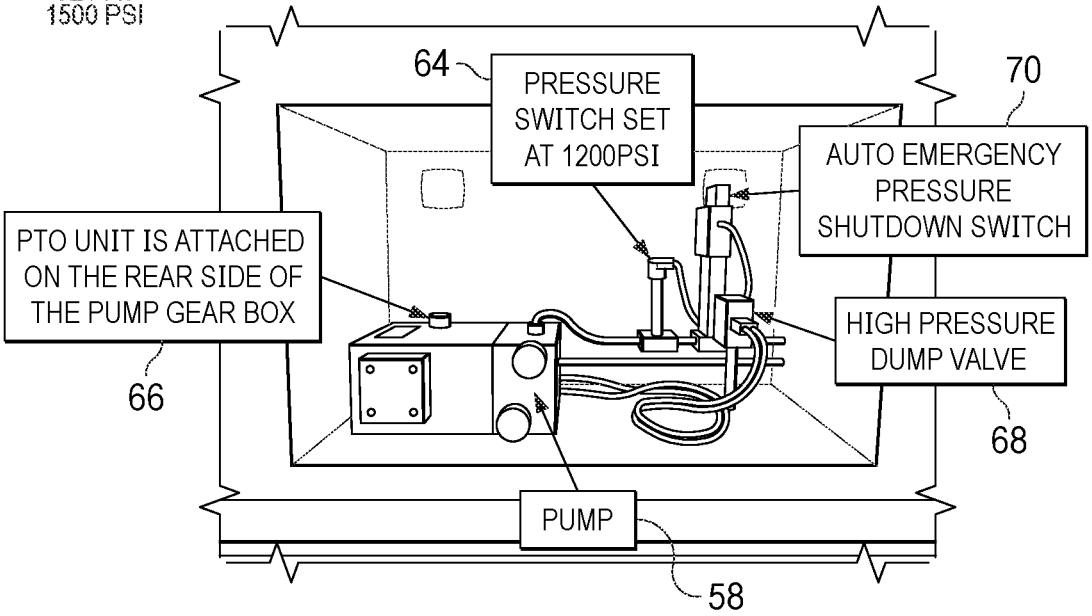

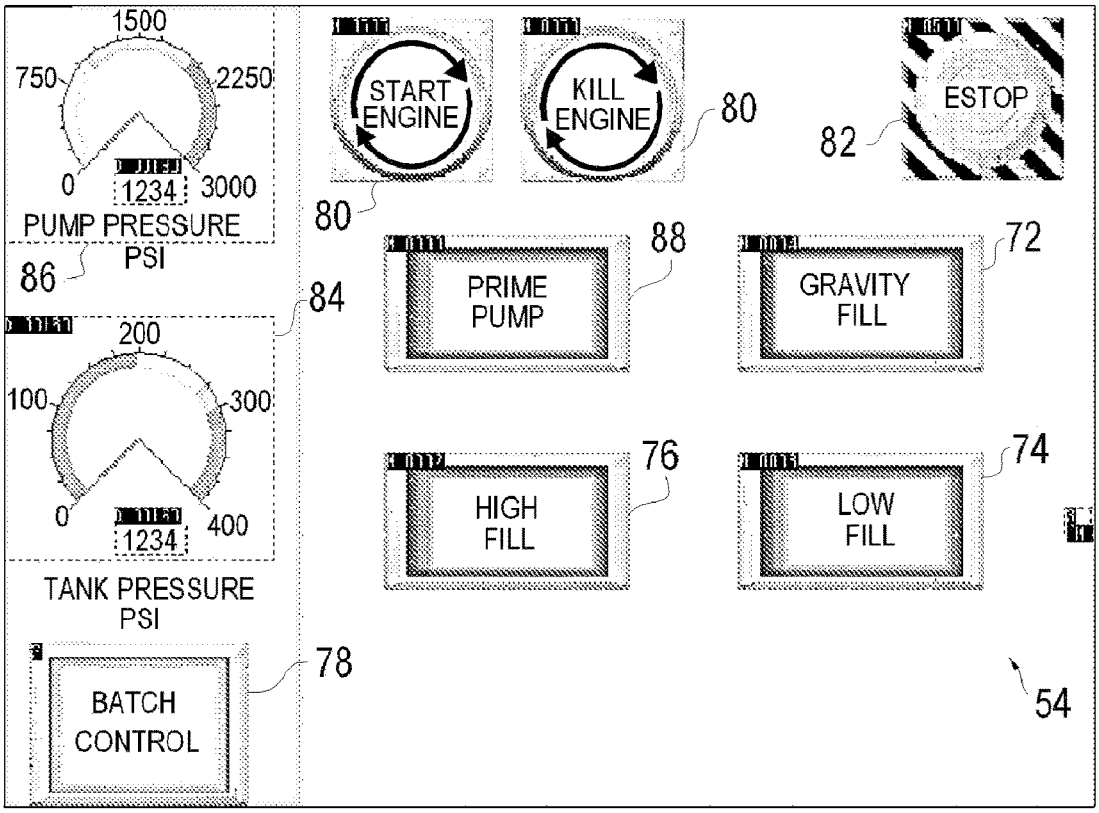
FIG. 8
FIG. 12
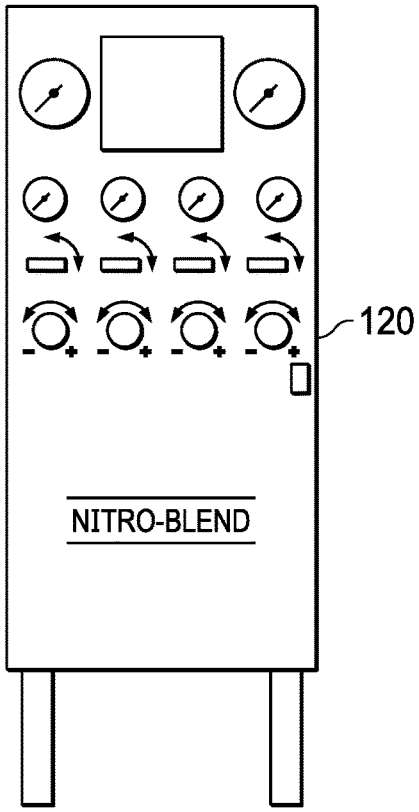

| BUTTON LABEL | INACTIVE | ACTIVE | DESCRIPTION OF FUNTION |
|---|---|---|---|
| START ENGINE BUTTON | START ENGINE 80 | START ENGINE 80 | MOMENTARY BUTTON TO ACTIVATE THE STARTER TO START THE PUMP MOTOR. |
| STOP ENGINE | KILL ENGINE 80 | KILL ENGINE 80 | MOMENTARY BUTTON TO STOP THE PUMP MOTOR. IF THE PUMP MOTOR WAS STARTED WITH A KEY THIS BUTTON WILL NOT STOP THE MOTOR. |
| PROGRAMMED E-STOP | ESTOP 82 | SYSTEM SHUTDOWN 82 | MAINTAINED BUTTON TO STOP THE PUMP MOTOR AND CLOSE THE MAIN VALVE. IF THE PUMP MOTOR IS STARTED WITH A KEY, THIS BUTTON WILL NOT STOP THE PUMP MOTOR. |
| PRIME PUMP | PRIME PUMP 88 | PRIMING 88 | MAINTAINED BUTTON TO PRIME THE PUMP. PUSHING THIS BUTTON OPENS THE ACTUATOR VALVE & ALLOWS LIQUID TO RETURN TO THE MAIN TANK. THIS BUTTON CAN ALSO BE USED TO BUILD MAIN TANK PRESSURE |
| GRAVITY FILL | GRAVITY FILL 72 | FILLING 72 | MAINTAINED BUTTON TO GRAVITY FILL A TANK. THIS BUTTON WILL STAY ACTIVE UNTIL IT IS PUSHED A SECOND TIME. |
| HIGH PRESSURE FILL | HIGH FILL 76 | FILLING 76 | MAINTAINED BUTTON TO HIGH PRESSURE FILL A TANK. THIS BUTTON WILL STAY ACTIVE UNTIL THE PUMP PRESSURE REACHES 1200 PSI. AFTER REACHING 1200 PSI THE PUMP MOTOR WILL SHUT OFF. |
| LOW PRESSURE FILL | LOW FILL 74 | FILLING 74 | MAINTAINED BUTTON TO LOW PRESSURE FILL A TANK. THIS BUTTON WILL STAY ACTIVE UNTIL THE PUMP PRESSURE REACHES 320 PSI. AFTER REACHING 320 PSI THE MOTOR WILL SHUT OFF. |
| CHANGE TO BATCH CONTROL SCREEN | BATCH CONTROL 78 | | MOMENTARY BUTTON TO GET TO THE BATCH CONTROL SCREEN. |

FIG. 9

MOBILE CO2 FILLING SYSTEM FOR FILLING ONSITE CO2 STORAGE AND DISPENSING SYSTEMS WITH CO2

RELATED APPLICATIONS

The present application claims priority of U.S. patent application Ser. No. 15/300,926 entitled "A MOBILE CO2 FILLING SYSTEM FOR FILLING ONSITE CO2 STORAGE AND DISPENSING SYSTEMS WITH CO2" filed Sep. 30, 2016, which was a national stage application under 35 U.S.C. 371 of PCT Application No. PCT/US2015/023546 having an international filing date of Mar. 31, 2015, which designated the United States, which PCT application claimed the benefit of U.S. Provisional Application Ser. No. 61/973,213, filed Mar. 31, 2014, all of which are incorporated by reference in their entirety.

BACKGROUND OF THE INVENTION

1. Field of the Invention

This invention generally relates to a mobile CO2 filling system for filling onsite storage and dispensing systems primarily for on-site refillable restaurant CO2 beverage dispensing systems, on-site refillable CO2 dispensing systems for green house plant enrichment, on-site refillable CO2 dispensing systems for swimming pool conditioning and other similar applications, and similar onsite CO2 refillable dispensing systems.

2. Background Information

As noted above this invention generally relates to a mobile CO2 filling systems for filling onsite storage and dispensing systems. One large application of onsite CO2 storage and dispensing systems is on-site refillable restaurant CO2 beverage dispensing systems. Reviewing a brief history of CO2 beverage dispensing systems may be helpful in understanding the present invention.

The beverage industry uses carbon dioxide to carbonate and to move beverages from a storage tank to a dispensing area. For beverages such as beer, the beer can be contained in large kegs in a remote location, e.g., the basement or storage room, and the taps at the bar can dispense the beer. This method eliminates the storage of beer kegs in the bar area and allows the beer keg delivery and removal to occur in an area other than that in which patrons may be sitting. This type of system has existed for many years as evidenced in U.S. Pat. No. 1,062,343 which issued in 1913.

In order to get the beverages from the storage area to the serving area, prior art has used carbon dioxide among other gases. The carbon dioxide is generally delivered as a liquid in large heavy DOT cylinders and hooked to the dispensing system. When the tanks are hooked to the system, a certain volume, generally about one third of the tank, in a one tank system or one third of the tank volume in a multi-tank system is not filled with liquid. This allows the carbon dioxide to boil to a gaseous state. It is this gaseous state that is then used to carbonate and to move the desired beverage from the storage room or basement to the delivery area and provide much of the carbonation to the beverages.

One problem with this general system is that the carbon dioxide tanks must be changed or when the current tanks run out, they must be replaced with new tanks. This can be inconvenient and time consuming. If only one person is working, then they are required to leave the patron area and manually change the tank to allow the refreshments to continue to flow. In addition, delivery of additional filled tanks cannot always occur when they are needed if a user runs out in the late evening or during non-business hours. This problem can be somewhat lessened by using multiple liquid tanks, but this uses more space and can be more expensive to monitor and refill.

To refill or replace a tank, the system must generally be completely shut down, so no beverages can be served, and service or delivery personnel can move the full liquid carbon dioxide tanks into the business and remove the empty tanks. Generally several valves must be shut off while the tanks are changed. The business must wait until the changeover is complete before beverages can be served again.

The above problems led to the development of onsite CO2 storage and dispensing systems where the physical changing of the tanks has been eliminated. See U.S. Pat. Nos. 6,601,618, 5, 113,905, 4,936,343 and 4,683,921 which are incorporated herein by reference. This is done by delivering liquid carbon dioxide to the in-situ tanks or system pre-existing in the businesses. Generally a pump truck delivers the liquid carbon dioxide to an inlet line plumbed to the outside of the building. However in early onsite CO2 storage and dispensing systems, the delivery personnel must then enter the establishment to close and adjust various valves. These early onsite systems were then shut down and the dispensing of beverages must cease until the filling process is complete. Delivery personnel were required to return to the truck and start the pump and then carefully monitor the system to attempt to determine when the system is full. This was difficult to determine with any uniformity in early onsite system. Some weeks a business may do very well with beverages and some weeks may not do so well. While an operator may get a general sense, it was difficult to determine without the trial and error method, when these early onsite systems were full. Some prior art onsite systems used relief valves to indicate when the system was full, namely the operator watched for the excess CO2 to actually come through a vent. This method of determining when the system is full is wasteful and can result in increased pressure hazards from over filling. Over filling can also result in the system not operating properly.

The deficiencies with these prior art onsite CO2 storage and dispensing systems largely minimized their wide adoption in the beverage industry. U.S. Pat. No. 7,258,127 addressed some of the problems with the prior art and provides a diverter valve, system and method for the delivery of gases or liquids where the delivery persons can fill the system without having to enter the building and the system can continue to deliver gas to the user. There is no interruption of service while the system is being filled. U.S. Pat. No. 7,258,127 is incorporated herein by reference in its entirety. Further improvements in this type of onsite CO2 storage and delivery system is disclosed in U.S. Pat. No. 8,844,555 which is incorporated herein by reference in its entirety. The advantages of the onsite CO2 storage and delivery systems of the '127 and '555 patents are resulting in a quickly growing number of establishments utilizing this type of onsite CO2 storage and dispensing system, and such users are not limited to restaurants but include breweries, pools, convenience stores and greenhouses. These systems, currently marketed under the brand GREEN CO2 SYSTEMS have been described as a "Game Changing Stationary, Non-Venting, Low Cost, Low Maintenance and totally Green CO2 Dispensing System." It has been tested by some 2,000 installations over the last 10 years. Additionally, after working on the system that was the subject of the '127 patent, John Smythe proposed a similar design that is the subject of U.S. Pat. No. 7,766,309, which is incorporated herein by reference, however there have been no apparent attempts to commercialize the specific system of the '309 patent such that the practical advantages of this specific design have not been established in the marketplace, but the '309 patent itself is further evidence of the growing acceptance of the advantages of onsite CO2 storage and delivery systems.

The inventors of the present invention, who have been instrumental in expanding the use and application of different onsite CO2 storage and delivery systems, have recognized a need for a flexible controllable mobile delivery platform for the distinct onsite CO2 storage and delivery systems. Increasing the ease of filling onsite CO2 storage and delivery systems will yield greater acceptance of their use and allow more commercial establishments to reduce their carbon footprint and save money through adoption of onsite CO2 storage and delivery systems. It is one object of the present invention to provide a cost effective, flexible, efficient mobile CO2 filling system for filling onsite storage and dispensing systems primarily for on-site refillable restaurant CO2 beverage dispensing systems, on-site refillable CO2 dispensing systems for green house plant enrichment, on-site refillable CO2 dispensing systems for swimming pool conditioning and other similar applications, and similar onsite CO2 refillable dispensing systems.

SUMMARY OF THE INVENTION

The above objects are achieved with a mobile CO2 filling system for filling onsite CO2 storage and dispensing systems with CO2, the system comprising: a mobile platform; a tank holding liquid CO2 mounted on the mobile platform; a flexible dispensing hose coupled to the tank and configured to be selectively coupled to the filling inlet of an onsite CO2 storage and dispensing system; A pump selectively coupled to the tank; and a controller for controlling the filling of an onsite CO2 storage and dispensing systems with CO2 from the tank, wherein the controller is selectively designated by the user to operate in at least one pump assisted filling state and at least one gravity feed filling state.

The mobile CO2 filling system according to the invention may provide a plurality of pump assisted filling states are provided to be selectively selected by the user, wherein the plurality of pump assisted filling states include filling at distinct pump operating parameters. The distinct pump operating parameters of distinct filling states may include one in which the pump automatically shuts off at a pressure less than 350 PSI and may include one in which the pump automatically shuts off at a pressure greater than 1100 PSI. The mobile CO2 filling system according to invention may provide that at least one pump assisted filling state includes a user inputting the number of cylinders to be filled and includes a user inputting the size of cylinders to be filled.

The mobile CO2 filling system according to the invention may provide that the controller records the amount of CO2 delivered to each specific onsite CO2 storage and dispensing system filled with the system and wherein the mobile platform is part of a vehicle.

The mobile CO2 filling system according to invention may provide that the controller includes a pump primer state configured to operate to fill the internal side of the pump with CO2 liquid, wherein the pump primer state is configured to build pressure within the tank.

The mobile CO2 filling system according to invention may provide that the flexible dispensing hose includes a quick release coupler for connecting to the onsite CO2 storage and dispensing system, and a vent position for venting CO2 within the flexible dispensing hose.

The mobile CO2 filling system according to invention may provide that the controller includes a button for a high fill pump assisted filling state, a button for a low fill pump assisted filling state and a button for gravity feed filling state, wherein the high fill pump assisted filling state has a higher pressure setting than the low fill pump assisted filling state. Further the controller may allow the user to selectively define the pressure for the high fill pump assisted filling state and for the low fill pump assisted filing state.

Another aspect of the invention provides a CO2 distribution system comprising a plurality of onsite CO2 storage and dispensing systems, each system located at a distinct commercial establishment and having system filling inlet and system venting exterior of a building housing the commercial establishment; and a mobile CO2 filling system for filling each onsite CO2 storage and dispensing systems with CO2, the mobile CO2 filling system comprising i) a mobile platform; ii) a tank holding liquid CO2 mounted on the mobile platform; iii) a flexible dispensing hose coupled to the tank and configured to be selectively coupled to the filling inlet of an onsite CO2 storage and dispensing system; iv) a pump selectively coupled to the tank; and v) a controller for controlling the filling onsite CO2 storage and dispensing systems with CO2 from the tank, wherein the controller is selectively designated by the user for operation in at least one gravity feed filling state.

These and other advantages are described in the brief description of the preferred embodiments in which like reference numeral represent like elements throughout.

BRIEF DESCRIPTION OF THE FIGURES

FIG. 1 is a schematic illustration of a CO2 distribution system according to the present invention comprising a plurality of onsite CO2 storage and dispensing systems and a mobile CO2 filling system for filling each onsite CO2 storage and dispensing systems with CO2 according to one aspect of the present invention;

FIG. 2 illustrates the components of an onsite CO2 storage and dispensing system which can be used in the CO2 distribution system according to the present invention;

FIG. 3 is a schematic layout of a typical onsite CO2 storage and dispensing system which can be used in the CO2 distribution system according to the present invention;

FIG. 4 is a schematic illustration of the diverter valve in a fill position in a typical onsite CO2 storage and dispensing system which can be used in the CO2 distribution system according to the present invention;

FIG. 5 is a schematic layout of a mobile CO2 filling system for filling each onsite CO2 storage and dispensing systems with CO2 according to one aspect of the present invention;

FIG. 6 illustrates the pump and PTO unit of the mobile CO2 filling system according to one aspect of the present invention;

FIG. 7 illustrates the flow meter and controller of the mobile CO2 filling system according to one aspect of the present invention;

FIG. 8 illustrates the main control panel of the controller of the mobile CO2 filling system according to one aspect of the present invention;

FIG. 9 is a chart of the touch screen buttons and associated function for the main control panel of the controller of the mobile CO2 filling system according to one aspect of the present invention;

FIG. 12 illustrates a nitrogen blending control system for use in certain onsite beverage CO2 storage and dispensing system which can be used in the CO2 distribution system according to the present invention.

DESCRIPTION OF THE PREFERRED EMBODIMENTS

Figure 10:
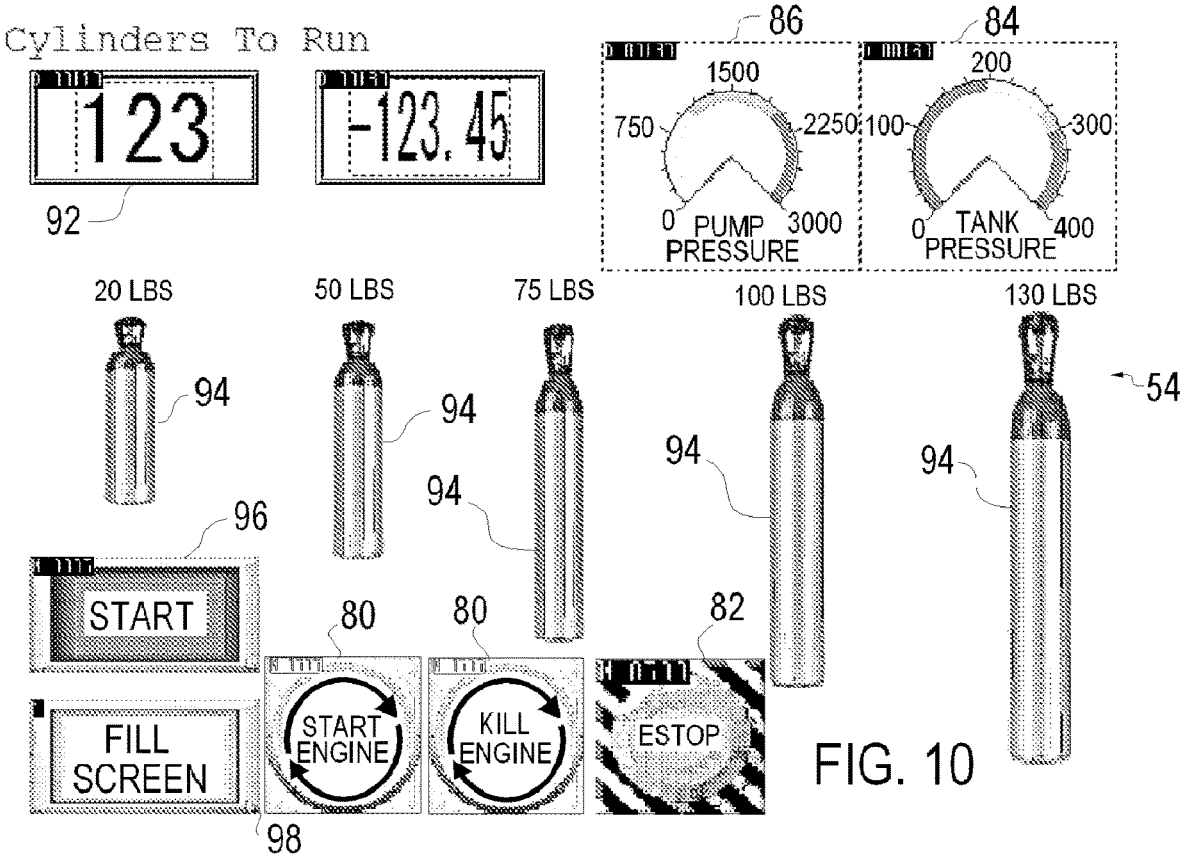
FIG. 10 illustrates a batch fill control screen for the main control panel of the controller of the mobile CO2 filling system according to one aspect of the present invention.

The present invention provides a CO2 distribution system comprising a plurality of onsite CO2 storage and dispensing systems 20, each system located at a distinct commercial establishment 30 and having system filling inlet and system venting exterior of a building 40 housing the commercial establishment 30. FIG. 1 schematic illustration of the CO2 distribution system according to the present invention illustrating one of the plurality of onsite CO2 storage and dispensing systems 20 and a mobile CO2 filling system 10 for filling each onsite CO2 storage and dispensing system 20 with CO2 according to one aspect of the present invention. The CO2 dispensing system 20 is used in beverage dispensing for restaurants, bars, convenience stores and the like. The CO2 dispensing system 20 is also used in green house plant enrichment, swimming pool conditioning and other similar applications.

Suitable onsite CO2 storage and dispensing systems 20 are made and supplied by Green CO2 Systems, headquartered in Fort Collins, Colo. The details of the dispensing system 20 are also described in U.S. Pat. Nos. 7,258,127 and 8,844,555 which are incorporated herein by reference in their entireties. As suggested above, Customers love the systems 20 because it allows them to be green by reducing their carbon foot-print and saving green. Distributors like the low cost and low maintenance as compared to the cryogenic vessels in the market place today and compared to carrying smaller high pressure cylinders in and out of the locations and trucking those cylinders back and forth from filling/distribution centers.

The present invention provides a mobile CO2 filling system 1O for filling each onsite CO2 storage and dispensing systems 20 with CO2, the mobile CO2 filling system 10 essentially comprises a mobile platform in the form of a truck (but a towed platform/trailer is also possible); a tank 52 holding liquid CO2 mounted on the mobile platform; a flexible dispensing hose 60 coupled to the tank and configured to be selectively coupled to the filling inlet 26 of an onsite CO2 storage and dispensing system 20; a pump 58 selectively coupled to the tank 52; and a controller 54 for controlling the filling of onsite CO2 storage and dispensing systems 20 with CO2 from the tank 52. The mobile CO2 filling system 10 described below provides distributors with greater efficiencies as they can fill the system 20 faster and effectively can run their trucks 24/7 without change outs for distinct system 20 requirements. Further efficiencies over some prior art system is possible because the delivery drivers do not have to enter the premises to fill the systems 20.

As should be apparent the System 20 supplies commercial enterprises 30 with a point of use CO2 dispensing system 20 which is filled periodically, as required, by a liquid CO2 Fill Truck 10. The systems 20 are preferably comprised of a diverter valve 24 described in detail in U.S. Pat. Nos. 7,258,127 and 8,844,555, gas and liquid CO2 onsite DOT 3AA CO2 high pressure storage cylinders 22, and a fill box 26 located on an outside wall of the building 40. The system may also effectively utilize a SAFE-T-FLO™ brand Line Monitor 28, which is described in detail in U.S. Pat. No. 8,757,437, entitled "Gas line leakage monitor for beverage dispensing system preventing unintended environmental discharge" which is incorporated herein by reference. The line monitor 28 is an optional component and it monitors the flow of CO2 gas and if a leak develops downstream from the Diverter Valve 24 it automatically stops the flow of CO2 gas saving the customer time and money as well as protecting the employees and customers from the dangers of CO2 contamination.

The heart of the CO2 dispensing system 20 is the diverter valve 24, which uses a shuttle valve to isolate incoming liquid CO2 during the fill process from the vapor cylinder(s) while allowing the liquid CO to fill the liquid cylinders 22. Other features of the diverter valve are: (a) a gas regulation valve for regulating the gas pressure to the dispensing point (customer's beverage dispensing machine, green house CO2 outlet nozzles, etc.); and (b) safety relief valves for both high pressure gas and for low pressure dispensing gas sections of the valve. The dispensing systems 20 have CO2 liquid and vapor cylinders 22 in various liquid-to-vapor-cylinder ratios. The ratio of liquid cylinders to vapor cylinders can be 1:0.75, 2:1 and 3:2. For example: 2:1 cylinder ratio equals 2 liquid cylinders 22 to 1 vapor cylinder 22 or 4 liquid cylinders 22 to 2 vapor cylinders 22 (as schematically shown in FIG. 3). A 3:2 cylinder ratio could be 3 liquid cylinders and 2 vapor cylinders. Considering the total volume of all the cylinders (vapor+liquid) of these three ratios, the combined vapor volume is never lower than 40% and is as high as 75% for a 1:0.75 liquid-to-vapor cylinder ratio. Further the liquid tanks 22 are typically only filled to a 90% capacity.

The system 20 may effectively utilize 0.0.T 3AA cylinders 22 such as 130 lbs., 100 lbs., 75 lbs. and 50 lbs. and are formed of high strength steel alloy with a minimum service pressure rating of 1800 psi and a minimum retest pressure of 3000 psi to meet the highest safety standards. Subsequent filling of the system liquid cylinders 22 to 1200 PSIG consistently yield a constant replacement liquid volume based upon a given commercial establishment 30 usage. Also, upon testing the results, with a digital scale, over several hundred trial fills, the vapor space left in the liquid cylinders 22, when shut off at 1200 PSIG, was held to 10% give or take a very small amount based upon the fill trucks 10 mass flow meter 56 reading after the fill cycle is completed. Because the liquid cylinders 22 are connected to a single header 24, their combined volume equals the liquid CO2 mass pumped into them plus what was already in the cylinders prior to the fill operation. The level in each liquid cylinder, as described above should be fairly even and with about 10% of vapor space, however, even if they are filled to near their maximum capacity the diverter valve's 24 shuttle valve immediately closes once the fill cycle is over and connects the liquid cylinders 22 to the vapor cylinders 22. As the vapor cylinder(s) 22 are 40-75% by volume of the combined capacity of the liquid cylinders 22 (plus whatever vapor space was left in the liquid cylinders), the system's 20 minimum vapor space is always greater than required by CO2 high pressure cylinder regulations (32% vapor space).

The liquid in the liquid cylinders immediately boils off until thermal-pressure equilibrium is reached. FIG. 3 illustrates a generalized 2:1 ratio hook-up of the Liquid and Vapor cylinders 22 to the diverter valve 24. Outlet port to customers dispensing system (30) can be isolated by the shut-off valve during filling. The Inlet fill port 26 is automatically shut when the fill line 60 from the fill truck 10 is disconnected.

As a quick overview of the filling process of filling the system 20 with the system or truck 10, the driver connects flexible dispensing hose 60 (which preferably includes a quick release coupler 61 for connecting to the outside fill box 26 of the onsite CO2 storage and dispensing system 20, and a vent 59 for venting CO2 within the flexible dispensing hose 60) to outside fill box 26, via the quick coupler 61, and uses the controller 54 to control the filling operation. Note: Filling of the system 20 can be accomplished without the need to shut the customers dispensing system 30 down or removing and replacing gas CO2 cylinders 22. Velocity and static pressure, generated by the incoming CO2 liquid from the fill hose 60, causes the shuttle valve within diverter valve 24 to unseat from the fill end and to seat on the inlet to the gas cylinders supply header. This header connects to the G1 and G2 ports of gas cylinders 22. All the liquid flows into the diverter valve and out through ports L1, L2, L3 and L4 to the liquid storage cylinders 22. Flow rate is typically between 35-50 lbs/min. The chamber formed inside the diverter valve 24, when the shuttle valve opens the fill port and closes the gas outlet ports, acts like a header. CO2 liquid entering the chamber is equally distributed between the liquid cylinders 22 connected to it. FIG. 4 schematically illustrates the diverter valve 24 shuttle valve in the fill position. When the diverter valve's shuttle valve is in the fill position it shuts off the flow path from the main header to the high pressure gas passageway. In this position the flow of CO2 liquid entering the diverter valve 24 main header is directed only to the liquid cylinders(s) 22 and is isolate from the vapor cylinder (s) 22. The system 10 will stop when the system 20 is filled. For example in a "high fill" state when a pressure of 1200 PSIG is reached, the liquid CO2 pump 58 automatically disengages. After pump 58 disengages, the hose 60 is moved into the vent position and the fill line from the fill box 26 to the diverter valve 24 is vented off, leaving the fill line, from the fill box 26 to the diverter valve 24, empty of CO2 and zero pressure at the fill box entry. After venting of fill line pressure, the hose 60 is disconnected from outside fill box 26 by releasing the quick coupler. The driver reels up the hose 60, and the controller has recorded the amount of CO2 dispensed for the given system 20 which the driver may record elsewhere and driver can proceed to the next customer and next system 20.

When the hose 60 and supply line is disconnected from the fill box 26, the 1200 psi pressure, holding the shuttle valve open, is reduced to atmospheric pressure, causing the shuttle valve to unseat from the gas supply header and reseat on the fill port. This places the diverter valve 24 in its normal operating mode and opens up a passage way between the liquid and the vapor cylinders 22. This allows the liquid cylinders 22 to immediately boil off gas to the vapor cylinder(s) 22 until temperature-pressure equilibrium is established in all cylinders (liquid and vapor cylinders) 22. The pressure in a typical system 20 decreases after the liquid cylinders 22 have been filled to 1200 PSIG and the shuttle valve closes and connects the liquid cylinders to the vapor cylinder(s). The system 20 decreases to approximately 850 PSIG after the system pressure-temperature equilibrium is reached. This is the normal operating pressure (850 PSIG) for such a typical high fill based system 20.

When the liquid cylinders 22 are connected to the vapor cylinders 22 by a common header of diverter 24, the cylinders 22 and the header are linked and can be visualized as one big volume (cylinder) and, in the case of a 2:1 installation has a 50% by volume vapor space (two 100 lb. liquid cylinders versus one 100 lb. vapor cylinder). Installations that have a 100 lb. liquid cylinder and a 75 lb. vapor cylinder would result in a minimum vapor space volume of 75% based upon the vapor cylinder being 75% of a 100 lb. liquid cylinder. Current regulations for maximum fill volume of pressurized CO2 cylinders with liquid is 68% liquid which leaves a vapor space of 32%. The system 20 vapor space exceeds the regulation requirements value of 32%.

The mobile CO2 filling system 10 for filling onsite CO2 storage and dispensing systems 20 with CO2 may effectively have has a 6000 lb. capacity tank 52 manufactured to DOT MC331 specification. Maximum operating tank pressure for such a tank 52 is 350 PSIG at −50 F. The system 10 (or collectively called a fill truck 10 in this embodiment) has the controller 54 perform automatic system functions as described in the fill procedure. The Fill truck 10 can service gravity fill, high and low pressure systems 20 from 14.7 PSIA (1 ATM) up to 1200 PSIG which is the maximum output pressure of the Fill truck's system 10. The system 10 incorporates automatic tank relief valves 62 associated with maximum tank pressure (set at around 345 PSI) and high pressure relief valves 68 to relieve the system pressure if it reaches 1200 PSIG. The SPONSLER™ CO2 flow meter 56 is a mass flow type meter that utilizes a turbine flow meter coupled with pressure and temperature inputs which communicate with a flow computer to accurately convert the turbines flow rate output from Hertz to flow in lbs./min of liquid CO2. The service fill truck 10 may further include a hydraulic cylinder lift for safely lifting cylinders onto the truck.

FIG. 8 represents the screen that appears on the touch screen controller 54 on startup of the truck fill system 10. This screen controls basic pressure fills for day to day activity and displays the system pump 58, and internal tank 52 pressures with displays 86 and 84, respectively. FIG. 9 is a table of touch screen buttons and displays on the home screen and the function that each button performs. The pump pressure 86 in the upper left hand corner indicates the pressure going to the hose reel 60. This is also the pressure of the system 20 being filled. The tank pressure 84 is the pressure of the inlet CO2 coming from the main tank 52 on the truck 10 (truck MC331 D.OT tank 52 can also be equipped with a liquid level capacitance probe to determine the liquid CO2 level in the tank 52).

The gravity fill button 72 is used to initiate and stop a gravity fill of a system 20. This button 72 will stay active until it is pushed a second time stopping the procedure. The low fill button 74 is used to initiate a present low pressure fill of a system 20. This button 74 will stay active until the pump pressure reaches the low pressure threshold, such as 320 PSI. After reaching the present low fill threshold, say 320 PSI, the pump motor 54 will shut off and the button 74 will no longer be active. The high fill button 76 is used to initiate a present high pressure fill of a system 20. This button 76 will stay active until the pump pressure reaches the present high pressure threshold, such as 1200 PSI. After reaching the present high fill threshold, say 1200 PSI, the pump motor 58 will shut off and the button 76 will no longer be active.

The batch control button 78 activates a batch control screen shown in FIG. 10 described below. Start engine button 80 and stop engine button 80 are used respectively to activate the starter (see pto unit 66) to start the pump motor 58 or to shut off the pump 58. Note that if the pump motor is started with a key, this kill engine button will not stop the pump motor. The E-stop or emergency stop button 82 will stop the pump motor and close the main Valve, however if the pump motor is started with a key this button will not stop the pump motor. The prime pump button 88 will condition the pump by removing air pockets and filling the internal side of the pump with pure CO2 liquid and can also be used to circulate the liquid via in and out of pump returning CO2 liquid to the main delivery tank 52 in order to build additional Delivery Tank Pressure.

Gravity Fill Procedure: 1) Connect hose 60 of system 10 to the outside fill box 26 via quick adapter. 2) Move fill gun handle of hose 60 to fill position. 3) Press Gravity Fill Button 72 located on the front of the touch screen panel of controller 54. 4) Once the system 20 has reached full capacity press Gravity Fill Button 72 once again to stop the filling. 5) Move fill gun handle of hose 60 to the vent position. 6) Disconnect hose 60 from fill box 26, return fill hose 60 to hose reel on system 10. 7) Operator may Record pounds of CO2 delivered by system 10 to system 20 which controller 54 tracks via mass flow meter 56 8) Fill completed—Proceed to next customer/system 20.

Low/High Pressure Pump Fill Procedure: 1) Connect hose 60 of system 10 to the outside fill box 26 via quick adapter. 2) Start the gasoline engine by pressing the start engine button 80 on the screen. Note: If the key is used the pump motor will not shut off automatically when pressure is reached and Note: If Pump is PTO 66 Driven skip step 2. 3) Press High or Low Pressure fill button 74 or 76 located on the front of the touch screen ((Low for Cryogenic type system 20, High for Cylinders 20). 4) Pump will automatically disengage once system 20 has reached full capacity. 5) After Pump disengages, move fill gun handle of hose 60 into the vent position. 6) After venting of fill line 60 pressure disconnect fill gun of hose 60 from outside fill box 26 by releasing quick coupler. 7) Return fill hose 60 back to hose reel. 8) Operator may Record pounds of CO2 delivered by system 10 to system 20 which controller 54 tracks via mass flow meter 56 9) Fill completed—Proceed to next customer/system 20.

Pump Priming Procedure: 1) If at any time the pump 58 is not pumping at peak flow rates the system 10 can be primed by pressing the "Prime Pump" button 88. This button 88 will open the valve to the main liquid delivery tank 52 and will stay open until the "fill button 72, 74, 76 or 78 is pressed. This will condition the pump 88 by removing air pockets and filling the internal side of the pump with pure CO2 liquid. This mode can also be used to circulate the liquid via in and out of pump returning CO2 liquid to the main delivery tank in order to build additional Delivery Tank Pressure. Conditioning of the pump 58 typically needs only to be done on the first fill of the day. Once the pump has cooled down and all feed lines have been primed, the pump will hold a continuous prime during the route delivery.

Pressing the batch control button 78 will bring up the Batch Control function screen display of FIG. 9. Cylinders 22 to be batch filled should be 100% empty when using batch control function. Cylinders 22 will fill to their specified liquid level within ±1 to 2%. A monthly cross check between the equipped flow meter and a cylinder scale, by the Owner/Operator, should be conducted. This will ensure that the calculated meter valve is + or −1-2%. The set value can be easily adjusted by increasing or decreasing the set value number located on the control panel's touch screen. Because current regulations require a vapor space of 32%, it is recommended to fill to 95% of the legal maximum fill level, assuring that the vapor space is always above 32%. This screen of FIG. 9 is used to fill cylinders 22 with specific amounts of liquid. This function works by sampling the output of the meter 56 and integrating the flow over time in the control. To use batch control: 1) Connect a cylinder 22 to the system 10. 2) Enter the number of cylinders to fill in the box 92. (To enter a number the user touches the box 92 and a keypad will appear on the screen and the user enters a number between 1 and 999 and presses enter). 3) The user selects a cylinder size via icons 94 appropriate for the amount of liquid to be dispensed. 4) The user Presses the start button 96 then presses the start engine button 80, or just press start button for PTO pump drive. 5) The poundage will count up from zero in the box adjacent box 92. 6) When the selected poundage is reached the actuator valve will open and return liquid to the truck tank (gas engine mode only. The PTO will disengage when the selected poundage is reached) 7) The User can Disconnect the filled cylinder 22. 8) The user Connects the hose 60 to the next cylinder 22 and press start 96 to begin repeating the process again and the next cylinder 22 will be filled. 9) The process is repeated until all cylinders are filled. 10) Operator may Record pounds of CO2 delivered by system 10 to system 20 of cylinders 22 which controller 54 tracks via mass flow meter 56 11) Fill completed—Proceed to next customer/system 20.

The system 10 allows the operator to access, with an appropriate code, a set-up screen in which the high fill and low fill limit values can be entered into the system 10 to allow the system 10 to be adjusted to distinct systems 20. The high fill limit number should generally never exceed 1200 PSI and the low fill limit value should generally never exceed 320 PSI. Also, in this additional control screen the valves can be manually operated to open and close to check functionality of the unit. The service fill truck CO2 pump 58 has a pressure sensor 64 and associated automatic shut-off valve in its discharge piping hook-up which is normally set at 1200 psig (setting done on control panels set up screen) for high pressure fill applications. When the pump discharge pressure reaches 1200 PSIG the flow of liquid CO2 to the fill hose 60 is shut-off via an automatic shut-off valve and the PTO 66 is disengaged to the pump unit. During the fill operation the operator monitors the fill pressure and can use the emergency stop 82 to shut-off the liquid CO2 pump 58. Mass quantity in pounds of CO2 dispensed, to liquid cylinders, is shown on Mass Flow Meter display 56 and may be recorded by controller 54.

Additional changes are anticipated to allow the systems 20 to be designed better for individual applications, such as the inclusion of the line monitor 28 discussed above. Further a CO2 sensor that will be incorporated into the monitor 28 to make the monitor 28 a true Leak/CO2 detector that will warn the customer with both visual and audio alarms and terminate the flow of all CO2. It also has the ability to monitor different floor levels of the location for added safety by using only one device instead of multiple units.

Figure 11:
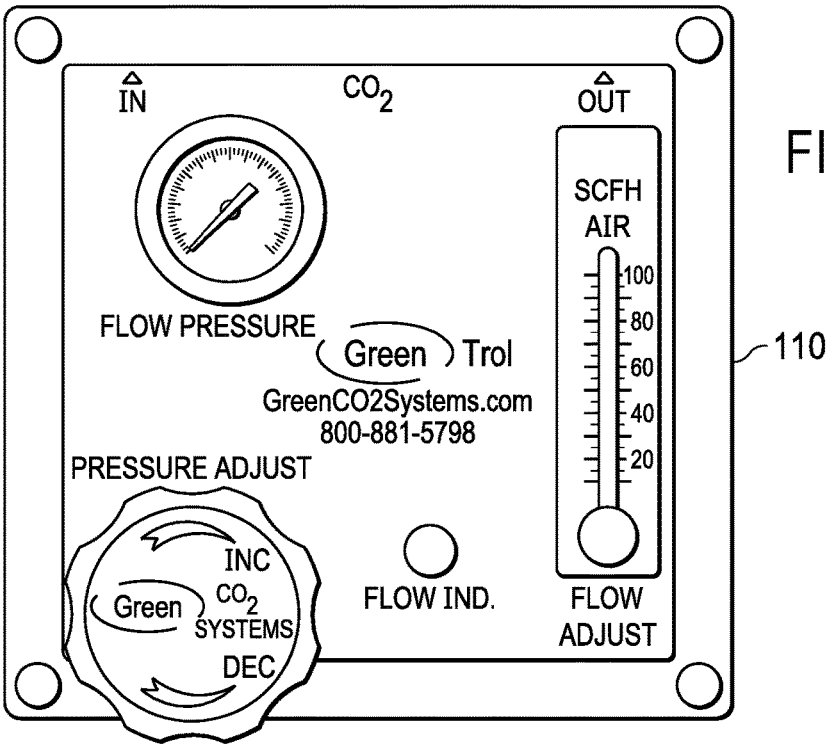
FIG. 11 illustrates a high flow control system for use in certain onsite CO2 storage and dispensing system which can be used in the CO2 distribution system according to the present invention.

Similarly FIG. 11 shows a unit 110 which is specifically designed Customers 30 Requiring Constant High Flow Rates of Carbon Dioxide, such as Greenhouses and Swimming Pools. The unit 110 Connects to any ppm (parts per million) controller, auto timer with single or multi-settings (Greenhouses) and auto PH controllers (Swimming Pools). The unit preferably includes a High cycle solenoid valve for added life, and high flow rated Regulator to eliminate freeze up, a flow meter for a precise regulated flow, with a green LED light for flow indicator. The unit 110 preferably operates on 24 volts.

FIG. 12 shows a nitrogen mixer control 120 that can be used with a system 20 and associated nitrogen tank (not shown) to allow for onsite generation of 99.8% Draught Beer-Grade Nitrogen, eliminating the need to purchase and store Mixed Gas Cylinders, The Nitro-Blend System with controller 120 blends CO2 with nitrogen using a MCLANTIM WTRUMIX™ triple blender to produce the desired nitrogen CO2 blend desired by the user.

The present invention may broadly be described as a mobile CO2 filling system 10 for filling onsite CO2 storage and dispensing systems 20 with CO2, the system 10 comprising: a mobile platform, namely a truck; a tank 52 holding liquid CO2 mounted on the mobile platform; a flexible dispensing hose 60 coupled to the tank 52 and configured to be selectively coupled to the filling inlet 26 of an onsite CO2 storage and dispensing system 20; a pump 58 selectively coupled to the tank 52; and a controller 54 for controlling the filling of onsite CO2 storage and dispensing systems 20 with CO2 from the tank, wherein the controller 54 is selectively designated by the user to operate in at least one pump assisted filling state and at least one gravity feed filling state.

While this invention has been particularly shown and described with references to preferred embodiments thereof, it will be understood by those skilled in the art that various changes in form and details may be made therein without departing from the scope of the invention encompassed by the appended claims.

What is claimed is:

1. A mobile CO2 filling system for filling onsite CO2 storage and dispensing systems with CO2, the system comprising:

a. a mobile platform;

b. a tank adapted to hold liquid CO2 mounted on the mobile platform;

c. a flexible dispensing hose comprising a first end and a second end, the first end interconnected to the tank;

d. a coupler interconnected to the second end of the hose, the coupler configured to be selectively coupled to a filling inlet of an onsite CO2 storage and dispensing system;

e. a vent interconnected to the hose for selectively venting CO2 from the hose while the coupler is coupled to the filling inlet;

f. a pump interconnected to the tank;

g. a selectable controller for controlling the filling onsite CO2 storage and dispensing systems with CO2 from the tank, wherein the selectable controller includes a plurality of pump assisted filling states to be selectively selected by a user; and h. at least one pressure sensor interconnected to the onsite CO2 storage system when the coupler is coupled to the filling inlet and adapted to detect the pressure within the onsite CO2 storage system, and wherein the selectable controller is adapted to shut off the pump when a pressure associated with a predetermined desired CO2 fluid level within the onsite CO2 storage system is detected.

2. The mobile CO2 filling system according to claim 1 wherein the plurality of pump assisted filling states include filling at distinct pump operating parameters.

3. The mobile CO2 filling system according to claim 2 wherein the distinct pump operating parameters of distinct filling states includes one in which the pump automatically shuts off at a pressure less than 350 PSI.

4. The mobile CO2 filling system according to claim 3 wherein the distinct pump operating parameters of distinct filling states includes one in which the pump automatically shuts off at a pressure greater than 1100 PSI.

5. The mobile CO2 filling system according to claim 1 wherein the at least one pump assisted filling state includes the number of cylinders to be filled.

6. The mobile CO2 filling system according to claim 5 wherein the at least one pump assisted filling state includes the size of cylinders to be filled.

7. The mobile CO2 filling system according to claim 1 wherein the controller records the amount of CO2 delivered to each specific onsite CO2 storage and dispensing system filled with the system and wherein the mobile platform is part of a vehicle.

8. The mobile CO2 filling system according to claim 1 wherein the controller includes a pump primer state configured to operate to fill an internal side of the pump with CO2 liquid.

9. The mobile CO2 filling system according to claim 8 wherein the pump primer state is configured to build pressure within the tank.

10. The mobile CO2 filling system according to claim 1 wherein the controller includes a button for a high fill pump assisted filling state, a button for a low fill pump assisted filling state and a button for a gravity feed filling state, wherein the high fill pump assisted filling state has a higher pressure setting than the low fill pump assisted filling state.

11. The mobile CO2 filling system according to claim 10 wherein the controller allows the user to selectively define the pressure for the high fill pump assisted filling state and for the low fill pump assisted filing state.

12. A CO2 distribution system comprising:

a. a plurality of onsite CO2 storage and dispensing systems, each system located at a distinct commercial establishment and having a filling inlet; and b. a mobile CO2 filling system for filling each onsite CO2 storage and dispensing systems with CO2, the mobile CO2 filling system comprising:

i. a mobile platform;

ii. a tank for holding liquid CO2 mounted on the mobile platform;

iii. a flexible dispensing hose interconnected to the tank and configured to be selectively coupled to the filling inlet of an onsite CO2 storage and dispensing system;

iv. a pump interconnected to the tank;

v. a selectable controller for controlling the filling onsite CO2 storage and dispensing systems with CO2 from the tank, wherein the controller of the mobile CO2 filling system is configured to allow a plurality of pump assisted filling states to be selectively selected by a user; and vi. at least one pressure sensor interconnected to the hose and adapted to detect the pressure within the onsite CO2 storage system, and wherein the selectable controller is adapted to shut off the pump when a pressure associated with a predetermined desired CO2 fluid level within the onsite CO2 storage system is detected.

13. The CO2 distribution system according to claim 12 wherein the plurality of pump assisted filling states include filling at distinct pump operating parameters.

14. The CO2 distribution system according to claim 12 wherein the controller of the mobile CO2 filling system includes a button for a high fill pump assisted filling state, a button for a low fill pump assisted filling state, and a button for a gravity feed filling state, wherein the high fill pump assisted filling state has a higher pressure setting than the low fill pump assisted filling state.

15. The CO2 distribution system according to claim 12 wherein the controller of the mobile CO2 filling system records the amount of CO2 delivered to each specific onsite CO2 storage and dispensing system filled with the system.

16. The CO2 distribution system according to claim 12 wherein the controller of the mobile CO2 filling system includes a pump primer state configured to operate to fill the intake side of the pump with CO2 liquid, and wherein the pump primer state is configured to build pressure within the tank.

17. The CO2 distribution system according to claim 12 wherein the mobile platform is part of a vehicle.

18. The CO2 distribution system according to claim 12 wherein the mobile CO2 filling system further includes a vent interconnected to the hose for selectively venting CO2 from the hose while the hose is coupled to a filling inlet.

* * * * *